US006027385A

United States Patent [19]

Katayama et al.

[11] Patent Number: 6,027,385

[45] Date of Patent: Feb. 22, 2000

[54] EXHAUST SYSTEM FOR OUTBOARD MOTOR

[75] Inventors: Goichi Katayama; Kazuhiko Watanabe; Noriyoshi Hiraoka; Masaki Okazaki, all of Hamamatsu, Japan

[73] Assignee: Sanshin Kogyo Kabushiki Kaisha, Hamamatsu, Japan

[21] Appl. No.: 09/199,729

[22] Filed: Nov. 25, 1998

Related U.S. Application Data

[63] Continuation-in-part of application No. 09/050,628, Mar. 30, 1998, Pat. No. 5,934,960.

[30] Foreign Application Priority Data

Nov. 27, 1997 [JP] Japan ..... 9-325929

[51] Int. Cl.[7] ..... B63H 21/32

[52] U.S. Cl. ..... 440/89

[58] Field of Search ..... 440/49, 53, 88, 440/89

[56] References Cited

U.S. PATENT DOCUMENTS 5,232,387 8/1993 Sumigawa ..... 440/89

5,671,779 9/1997 Koishikawa et al. ..... 440/89

5,733,157 3/1998 Ozuzawa et al. ..... 440/89

*Primary Examiner*—Stephen Avila

*Attorney, Agent, or Firm*—Knobbe, Martens Olson & Bear LLP

[57] ABSTRACT

A number of embodiments of four cycle outboard motors that have water cooled engines and an oil pan that is formed in the upper portion of the drive shaft housing. An exhaust pipe collects exhaust gases from an exhaust guide and delivers to a cavity that is formed in the oil pan by an interior wall thereof In many embodiments the exhaust pipe does not terminate below the lower surface of the oil pan and several arrangements are disclosed for delivering idle exhaust gases to the area between the exterior of the exhaust pipe and the interior surface of the oil pan that defines the cavity. Various arrangements are disclosed for conveying idle exhaust gases to this area and discharging them to the atmosphere through and above the water exhaust gas discharge. These arrangements incorporate a system for precluding water from entering into the engine through its exhaust system including the idle discharge.

15 Claims, 15 Drawing Sheets

EXHAUST SYSTEM FOR OUTBOARD MOTOR

CROSS REFERENCE TO RELATED APPLICATION

This application is a continuation in part of the application of the same title, U.S. Ser. No. 09/050628, filed Mar. 30, 1998 now U.S. Pat. No. 5,934,960, in the names of all inventors hereof except Masaki Okazaki and assigned to the assignee hereof.

BACKGROUND OF THE INVENTION

This invention relates to an outboard motor exhaust system and more particularly to an improved exhaust system for an outboard motor having a four-cycle internal combustion engine.

As is well known, the compact nature of outboard motors creates a number of unique and difficult design challenges for engineers. One of the major areas where these design concerns arise is in connection with the exhaust system for the outboard motor. Because of the relatively small size available, the types of silencing arrangements utilized in other engine applications are not available.

Therefore, the silencing of the exhaust gases must be done in major part either in the drive shaft housing through which the exhaust gases exit to the atmosphere and/or by discharging the exhaust gases from an area below the water, thus utilizing the body of water in which the watercraft operates as a silencing medium.

The underwater exhaust gas discharge is useful in providing some silencing, but under many running conditions of the watercraft, the underwater discharge is too low to permit effective exhaust gas discharge. Thus, most outboard motor exhaust systems employ a high speed, underwater exhaust gas discharge and a more restricted, above the water, idle exhaust gas discharge.

This latter exhaust gas discharge is utilized to discharge the exhaust gases to the atmosphere through the drive shaft housing and above the body of water in which the watercraft is operating under idling, trolling, and other low engine speed operating condition.

Obviously, some silencing arrangement must be employed for silencing the exhaust gases that flow through the above the water, idle exhaust gas discharge. In addition, a silencing arrangement is also employed to assist in the underwater discharge for silencing of the exhaust gases when traveling at higher speeds.

The problems of effectively silencing the exhaust gases and discharging them to the atmosphere are significantly magnified when the outboard motor is powered by a four cycle internal combustion engine. Four cycle engines obviously require a lubricating system that has a fairly large reservoir for lubricant recirculation.

Normally, the lubricant is stored in a lubricant tank that is supported form the underside of the exhaust guide which is, in turn, positioned at the upper end of the drive shaft housing. The engine is mounted on this exhaust guide and the exhaust gases are discharged downwardly from the engine through the exhaust guide. This arrangement has a number of disadvantages.

First, the exhaust system and the oil tank compete for space in the already limited drive shaft housing. Secondly, it should be ensured that the exhaust gas heat does not readily dissipate to the oil pan to cause undue heating of the lubricant Furthermore, these types of systems generally require a long exhaust pipe that extends below the lower end of the oil pan and hence in a location where the exhaust pipe may be in proximity to the water level, under many running conditions.

This latter problem is particularly acute when engine speed is controlled by cylinder disabling, as is frequently done to permit smooth operation at low speeds. When cylinder disabling is encountered, negative pulses may exist in the exhaust pipe and these could draw water back upwardly toward the engine cylinder. Even if cylinder disabling is not employed, if the engine performance is to be improved by extending the intake period so that the intake valve is open before the exhaust valve closes, negative pressures may be experienced in the exhaust conduit. Thus, like two cycle engines there is a risk that the negative pressure may draw water into the engine through the exhaust system.

It is, therefore, a principal object of this invention to provide an improved, simplified and compact exhaust arrangement for a four-cycle outboard motor.

It is a further object of this invention to provide an exhaust system for a four-cycle outboard motor wherein the exhaust pipe is configured relative to the oil pan so as to provide silencing and also to ensure against water intrusion into the engine.

In addition to the main exhaust gas discharge problems afore-described, the utilization of an above the water exhaust gas discharge also is complicated when the exhaust system passes in part through the oil pan. With such arrangements, the idle exhaust must be delivered downwardly below the oil pan and then find the path back up to the above the water exhaust gas discharge. This can result in high back pressure and also the possibility of water intrusion.

It is, therefore, a still further object of this invention to provide the improved idle exhaust gas discharge arrangement for a four cycle outboard motor.

It is a yet further object of this invention to provide an improved idle exhaust gas discharge for a four cycle outboard motor wherein good silencing is accomplished and the cooling water need not be primarily employed to assist in the silencing.

When the exhaust pipe passes through or in proximity to the oil pan, then it is desirable to ensure against heat transfer, as discussed above. Also the exhaust gas impingement on the oil pan surface may cause corrosion. One way heat transfer and corrosion of the oil pan can be reduced or controlled is by discharging at least some of the cooling water from the engine also in the area around the exhaust pipe and between the exhaust pipe and the oil pan. This, however, further increases the risk of water becoming entrapped in the exhaust system or entering through the idle exhaust gas discharge.

It is, therefore, a still further object of this invention to provide an improved idle exhaust gas discharge arrangement for a four-cycle outboard motor wherein the exhaust gas can be discharged in proximity to the cooling water from the engine but wherein they are shielded from this cooling water or otherwise protected from water intrusion so that water cannot enter the engine through the idle exhaust gas discharge passage.

SUMMARY OF THE INVENTION

Several of the features of the invention are adapted to be embodied in a four cycle outboard motor that is comprised of a power head. An exhaust guide supports at least in part a four cycle internal combustion engine in the power head. The exhaust guide is supported at the upper end of the drive shaft housing and lower unit that depends from the power head. A drive shaft driven by the engine is journaled within the drive shaft housing and lower unit and drives a propulsion unit therein for propelling an associated watercraft through a body of water. An oil pan is supported at least in part on the underside of the exhaust guide within the drive shaft housing and lower unit for containing lubricant for the engine. The oil pan defines an internal cavity which passes vertically therethrough. An exhaust pipe depends from the exhaust guide and receives exhaust gases from the engine for delivering them to the drive shaft housing and lower unit. The exhaust pipe extends through the oil pan internal cavity.

In accordance with a first feature of the invention, the exhaust pipe terminates at a point that is no lower than substantially the lower surface of the oil pan.

In accordance with another feature of the invention, the engine is water-cooled and coolant from the engine cooling jacket is discharged into the oil pan internal cavity around the exhaust pipe. The exhaust pipe has an idle exhaust gas discharge that is protected from intrusion by the coolant flowing from the engine cooling system.

In accordance with another feature of the invention, one of the walls of the oil pan that defines the internal cavity is exposed to the interior of the drive shaft housing on its other side and is not wetted by the lubricant in the oil pan. The exhaust pipe has an idle exhaust gas discharge passage formed along its length. The oil pan unwetted wall has an opening that is spaced therefrom for receiving the idle exhaust gases and discharging them to the atmosphere through an opening in the upper portion of the outboard motor and which is disposed above the water level at all times during watercraft operation.

FURTHER DESCRIPTION OF THE PRIOR ART

Figure 1:
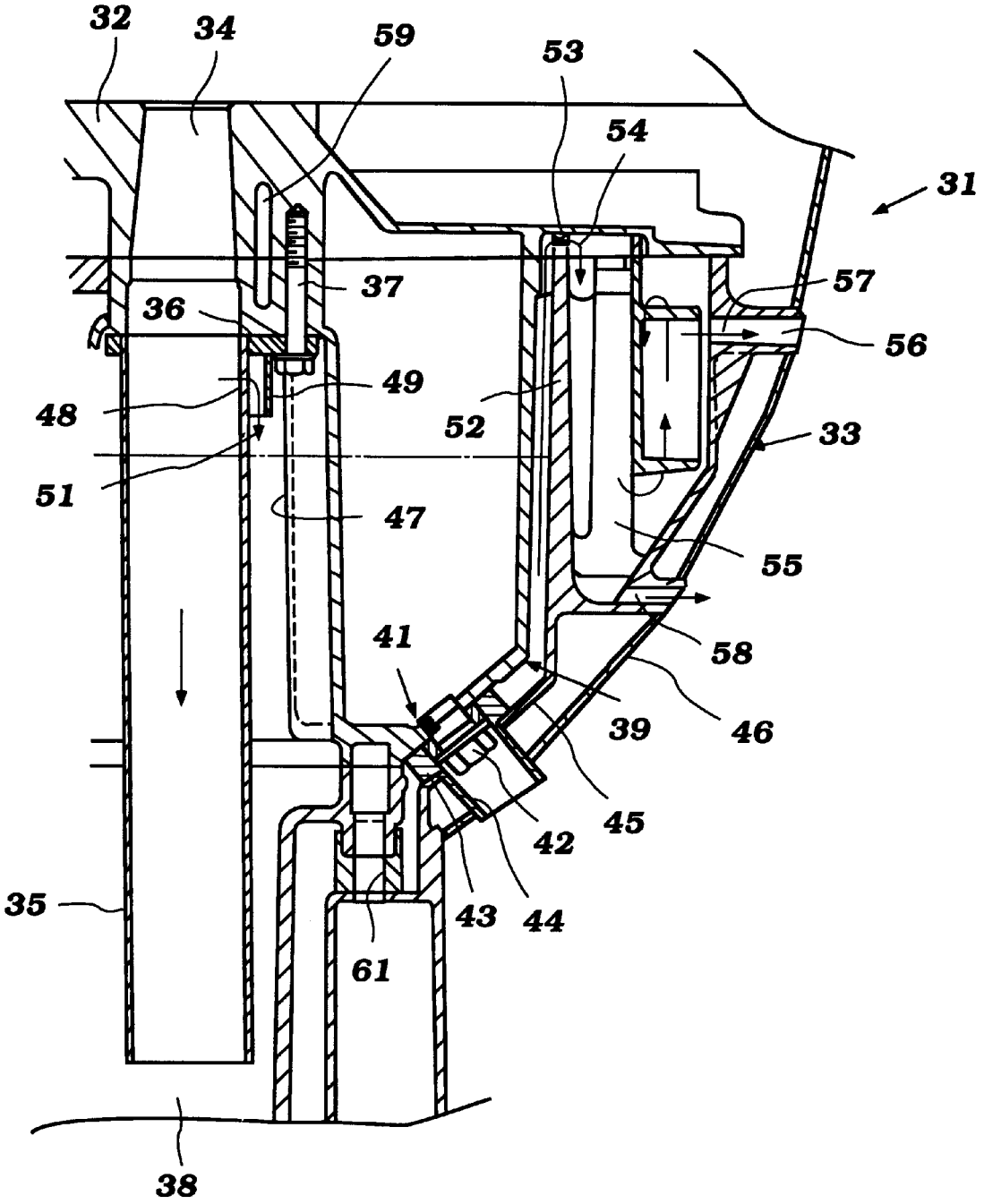
Figure 1 Prior Art
FIG. 1 is a partial cross-sectional view taken through an outboard motor constructed in accordance with a prior art type construction and which is illustrated in order to describe the problems of the prior art.

Although the problems attendant with the prior art constructions have been described above, it is believed that a descriptive figure will be helpful to permit those skilled in the art to understand the problems of the prior art constructions. FIG. 1, therefore, is a partial view of a prior art type of outboard motor, indicated generally by the reference numeral 31 and shows primarily the exhaust system associated with it.

The conventional outboard motor 31 includes a power head, which is not shown but which extends above an exhaust guide 32 that is fixed and supported in a suitable manner across the upper end of a drive shaft housing unit, indicated generally by the reference numeral 33. This exhaust guide 32 has an exhaust passage 34 that communicates with the discharge end of an exhaust manifold of an internal combustion engine which is supported in the aforenoted power head and which is not illustrated.

An exhaust pipe 35 has a flanged portion 36 that is affixed to the underside of the exhaust guide 32 by threaded fasteners 37. The exhaust pipe 35 has an inlet end that is configured to be complementary to the exhaust guide exhaust passage 34 so as to collect the exhaust gases and deliver them downwardly to an expansion chamber 38 that is formed in the drive shaft housing lower unit 33.

The engine, as has been noted is not shown, is of the four cycle type. Therefore, there is provided an oil pan or oil reservoir 39 that is mounted on the underside of the exhaust guide 32 in a suitable manner and which contains lubricant for the engine.

This oil pan 39 is formed with an oil drain arrangement 41 that includes a drain plug 42 that is tapped into a threaded opening in the lower wall of the oil pan 39. A sealing gasket 43 surrounds the drain plug 42 and the drain plug is accessible through an access opening 44 formed in the drive shaft housing 33. This permits the lubricant to be drained from the oil pan 39 without its removal from the outboard motor 31.

The drain plug 42 extends through an inner wall 45 of the drive shaft housing 33 and which is surrounded by a cowling portion 46.

It should be seen that the oil pan 39 is formed with an inner wall 47 that surrounds the exhaust pipe 35. The lower wall of the oil pan 39 terminates well above the lower end of the exhaust pipe 35. This means that when the outboard motor 31 is operating at idle or curling condition, the end of the exhaust pipe 35 may be quite close to the water level. If misfiring occurs, either accidentally or intentionally to control the speed of the engine, or if there is an overlap between the opening of the intake valves and the closing of the exhaust valves negative pressure pulses may exist in the exhaust pipe 35. The water may then be drawn upwardly into the exhaust system when this occurs, obviously not a desirable condition. This latter condition will be described later by reference to FIG. 2.

The exhaust gases from the expansion chamber 38 are discharged to the atmosphere through a conventional underwater high-speed exhaust gas discharge. This may include a known type of through the hub underwater discharge.

Under low speed and low loads, however, the exhaust gases are delivered to the atmosphere through an above the water exhaust gas discharge. This is done because the back pressure would be too high to permit the discharge of the exhaust gases through the main exhaust system.

This idle discharge system includes a restricted passage 48 that is formed in the upper part of the exhaust pipe 35. The exhaust gases pass through this opening 48 and are deflected away from the oil pan wall 47 by a baffle 49. The exhaust gases then flow downwardly as indicated by the arrow 51 to an area between the outer surface of the oil pan 39 and an inner surface wall 52 of the drive shaft housing 45. These exhaust gases then flow upwardly and through a restricted passageway 53 in the wall 52 as shown by the arrow 54. The exhaust gases then pass into an expansion chamber 55 formed by a further wall and which then can flow to the atmosphere through an idle discharge passage 56 formed in the drive shaft housing 33 in the direction of the arrow 57.

A water drain 58 is formed at the lower end of the expansion chamber 55 so that water that may be entrapped with the exhaust gases 10 drains back to the body of water in which the watercraft is operating.

The engine, which is not shown, has a water cooling system that includes a cooling jacket through which coolant is circulated by a water pump in a known manner. This coolant is then discharged at least in part to a cooling jacket 59 formed in the exhaust guide 32 around the exhaust passage 34. This water then fills a weir type device surrounding the oil pan 39 for its cooling and is discharged downwardly through a drain passage 61 for discharge through the lower unit in a known manner.

It should be seen that this idle discharge system requires a fairly substantial path for the idle gases to pass and does bring them into somewhat direct contact with the cooling water. Thus, there is some possibility, although slight, that water might find its way back into the exhaust system.

Figure 2:
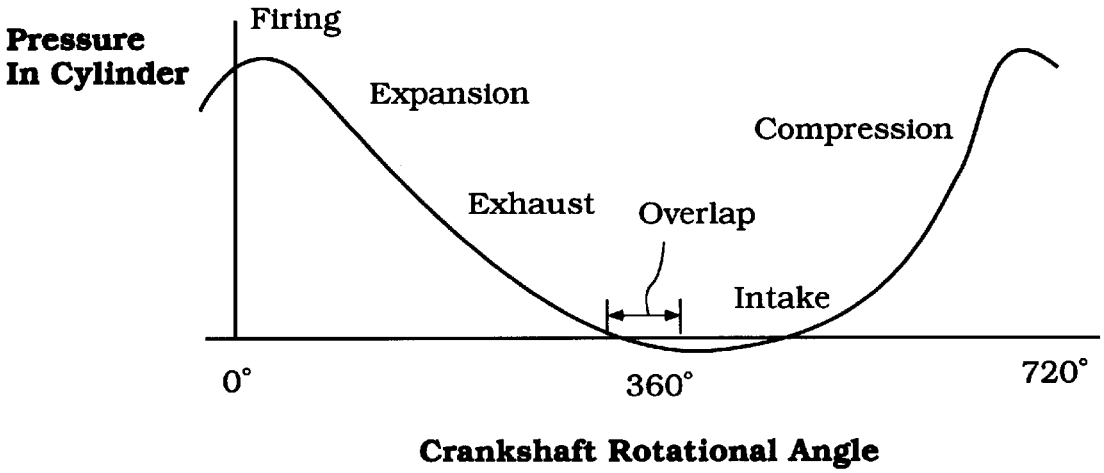
FIG. 2 is a graphical view showing how the pressure in the cylinder varies during a cycle of engine operation when there is overlap between the opening of the intake valve and the closing of the exhaust valve.
Figure 3:
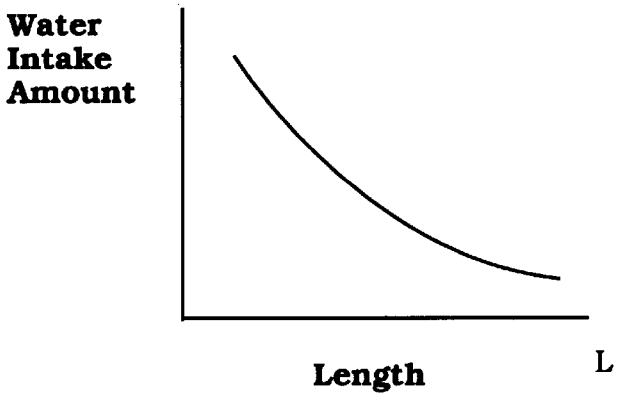
FIG. 3 is a graphical view showing how the length between the end of the exhaust manifold and the idle exhaust gas discharge affects the volume of water that may be inducted into the engine through this path.

FIGS. 2 and 3 show how the conditions can arise that can cause water to be drawn into the engine through the exhaust system and also the theory by which the invention operates to preclude this.

As may be best seen in FIG. 2, this illustrates the pressure in the combustion chamber during a complete cycle of operation. If, in order to improve the power output, the intake valves are set to open before the exhaust valves close to ensure good charging, then as may be seen at a time when both valves are opened, the pressure will tend to go negative and thus, there can be a suction generated that will tend to cause water to elevate into the exhaust system.

FIG. 3 shows the length of distance between the exhaust ports of the engine and the exhaust idle gas discharge opening and indicates that the longer this distance, the less water is likely to be ingested into the system. Thus, in accordance with a feature of the invention, the idle discharge is formed in the exhaust pipe at a relatively long distance from the exhaust ports so as to reduce this possibility. That is, the negative pressure existent will only cause the water to rise to a certain height and if this height is less than the length of the exhaust discharge opening to the exhaust port, water will not be ingested.

DETAILED DESCRIPTION OF THE PREFERRED EMBODIMENTS

It is believed that the foregoing description will enable those skilled in the art to readily understand the disadvantages and problems in connection with certain prior art types of construction. Therefore, the first embodiment of the invention which overcomes these difficulties will be described by particular reference to FIGS. 4–8.

An outboard motor constructed in accordance with this embodiment is shown in more detail and is indicated generally by the reference numeral 101. The outboard motor 101 is comprised of a power head, indicated generally by the reference numeral 102. This includes an internal combustion engine, which is shown in phantom and which is identified generally by the reference numeral 103.

In the specific embodiments illustrated, the engine 103 is a two cylinder, inline type of four cycle engine. The construction of the engine 103 will be described in more detail later by reference to FIG. 8. Although the invention is described in conjunction with such an engine, it should be readily apparent that the invention can be utilized with engines having other cylinder numbers and other configuration. The invention does, however, have particular utility with four cycle engines because of their need for a separate lubricating system and lubricant reservoir within the outboard motor.

The power head 102 is completed by a protective cowling which encircles the engine 103. This protective cowling is comprised of a lower tray 104 preferably formed from a lightweight high-strength material such as aluminum or aluminum alloy. In addition, a main removable cowling member 105 is detachably connected to the tray 104 and encloses in substantial part the engine 103. The main cowling member 105 is formed preferably from a lightweight high-strength material. A molded fiberglass reinforced resin or the like is normally utilized for this purpose.

As is typical with outboard motor practice, the engine 103 is supported within the power head 102 so that its crankshaft 106 rotate about a generally vertically disposed axis. This is to facilitate a driving connection to a drive shaft 107 that is rotatably journaled in a suitable manner within a drive shaft housing and lower unit, indicated generally by the reference numeral 108. This drive shaft 107 depends downwardly into a lower unit portion 109 of the drive shaft housing and lower unit assembly 108. The drive shaft 107 there drives a propeller shaft 111 through a conventional bevel gear reversing transmission 112. A propulsion device such as a propeller 113 is fixed for rotation with the propeller shaft 111 for propelling an associated watercraft, to be described shortly, to which the outboard motor 101 is affixed in a manner which will also be described, through the body of water in which the watercraft is operating.

An exhaust guide 114 extends across and is affixed to the upper end of the drive shaft housing 108 in a known manner.

The engine 103 is supported on this exhaust guide 114. The engine 103 has a suitable internal exhaust manifold that has a discharge end which mates with an exhaust passage 115 (FIGS. 4 and 5) of the exhaust guide 114. An exhaust pipe 116 is affixed, in a manner to be described, to the lower end of the exhaust guide 114 and collects the exhaust gases. These exhaust gases are then discharged, in a manner which will be described, through an internal cavity formed in an oil pan, indicated generally by the reference numeral 117 and which has a construction as will be described.

The oil pan 117 contains lubricant for the engine 103. This lubricant is circulated by means of an oil pump 118 which is driven from the engine 103 in a suitable manner. For example, the oil pump 118 may be driven off the end of a cam shaft (not shown) of an overhead cam shaft mechanism for the engine 103.

Figure 4:
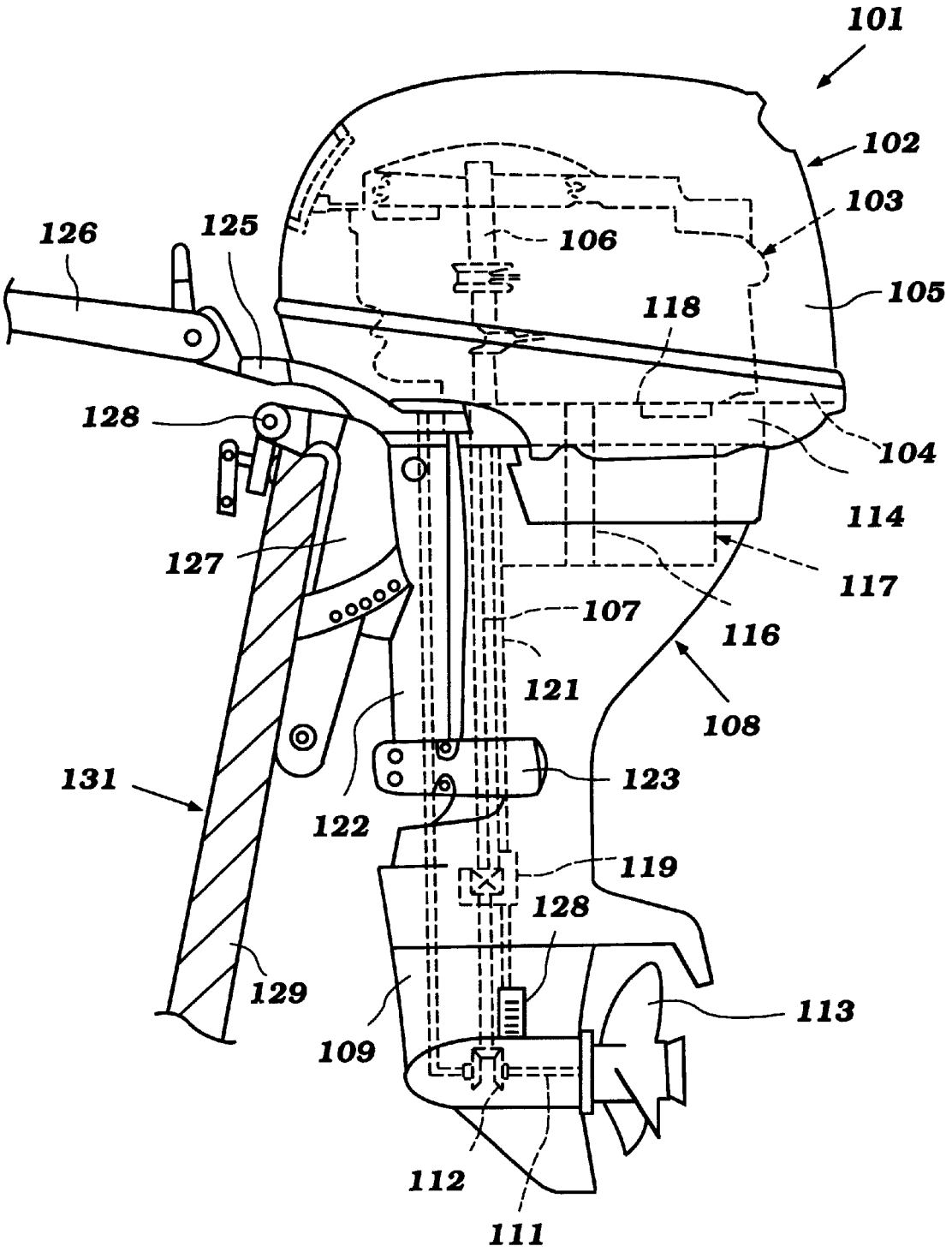
FIG. 4 is a side-elevational view of an outboard motor constructed in accordance with a first embodiment of the invention and shown attached to the transom of a watercraft which is shown only partially and in cross-section.

Continuing to refer primarily to FIG. 4, the engine 103 is also water-cooled. Coolant is circulated through the cooling jacket of the engine 103 by means of a water pump 119. The water pump 119 is mounted at the lower portion of the drive shaft housing 108 above the lower unit 109 and is driven by the drive shaft 107. A water inlet opening 121 in the lower unit 109 delivers water to the inlet side of the water pump 119.

This water is then pumped upwardly for circulation through the engine cooling jacket through a water delivery pipe 121, which will also be described in more detail later.

A steering shaft (not shown) is rotatably journaled within a swivel bracket 122. This steering shaft is connected to the drive shaft housing and lower unit assembly 108 by a lower mounting bracket 123 and an upper mounting assembly. These mounting brackets 123 and 122 support the steering shaft for steering movement of the outboard motor 111 about a vertically extending steering axis defined by the swivel bracket 122.

The steering shaft has affixed to its upper end a tiller 125 to which a pivoted tiller control 126 is mounted for control of the outboard motor's steering position.

The swivel bracket 122 is, in turn, affixed for pivotal movement to a clamping bracket 127 by a pivot pin 128. Pivotal movement of the swivel bracket 122 and, accordingly, the outboard motor 101 about the pivot pin 128 achieves tilt and trim movement of the outboard motor 101, as is well known in this art.

The clamping bracket 127 is detachably connected by a suitable mechanism to a transom 129 of a watercraft 131. Hence, the outboard motor 101 will propel the watercraft 131 in a well-known manner through the body of water in which the watercraft operates.

Figure 5:
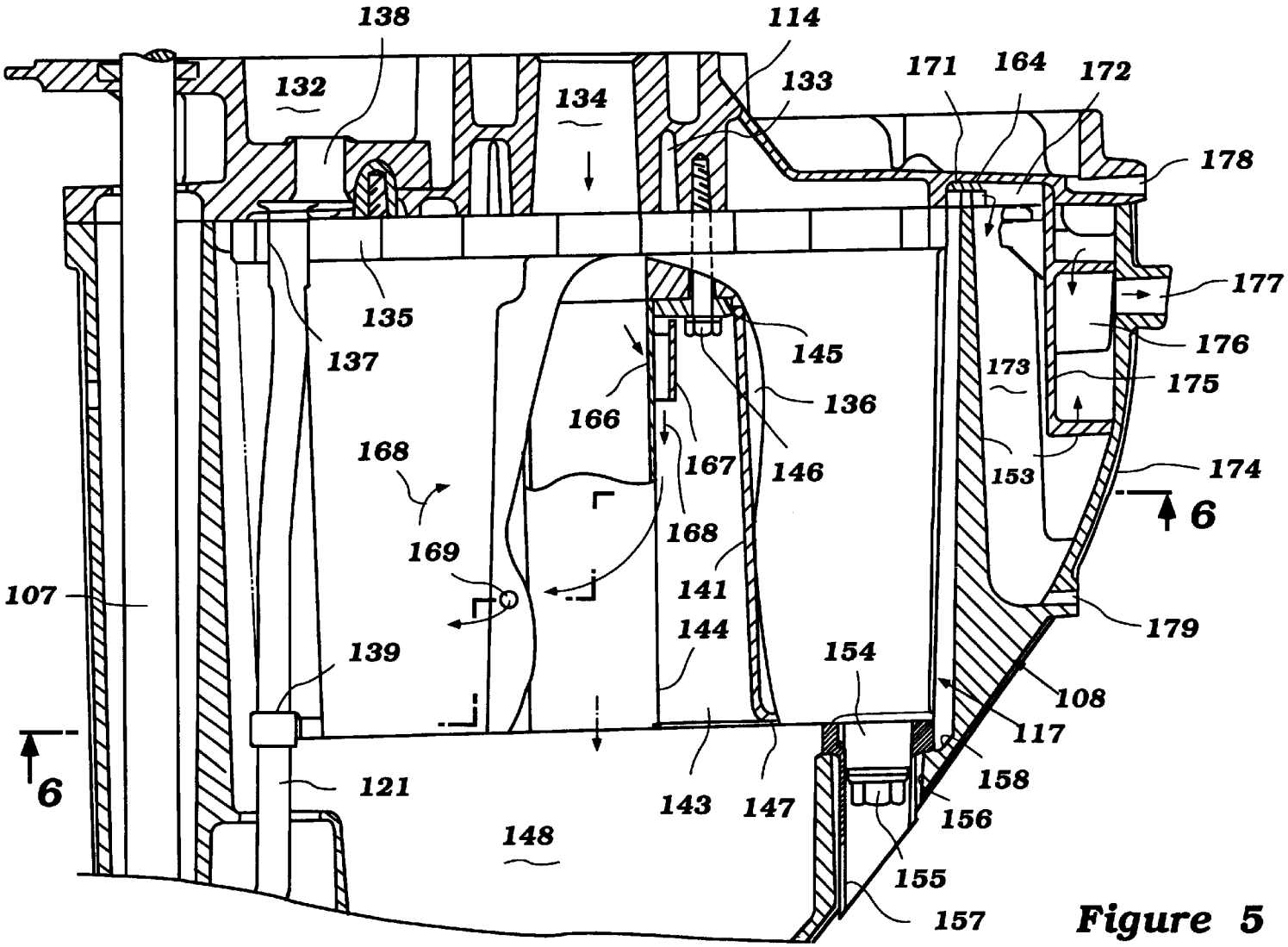
FIG. 5 is a cross-sectional view, in part similar to FIG. 1, but showing the first embodiment of the invention.
Figure 6:
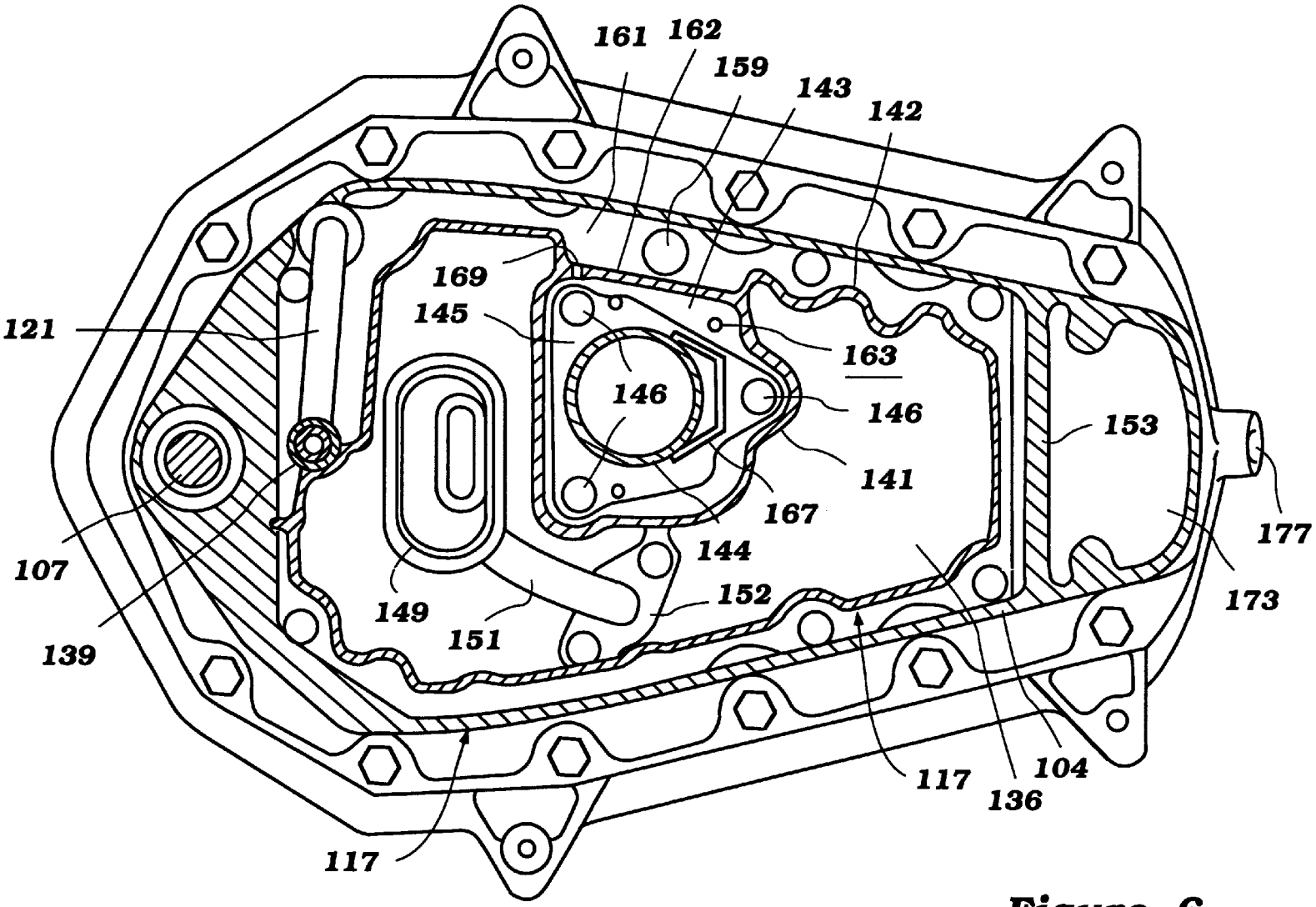
FIG. 6 is a partial cross-sectional view taken through the upper portion of the drive shaft housing and lower unit and is taken generally along the line 6—6 of FIG. 5.
Figure 7:
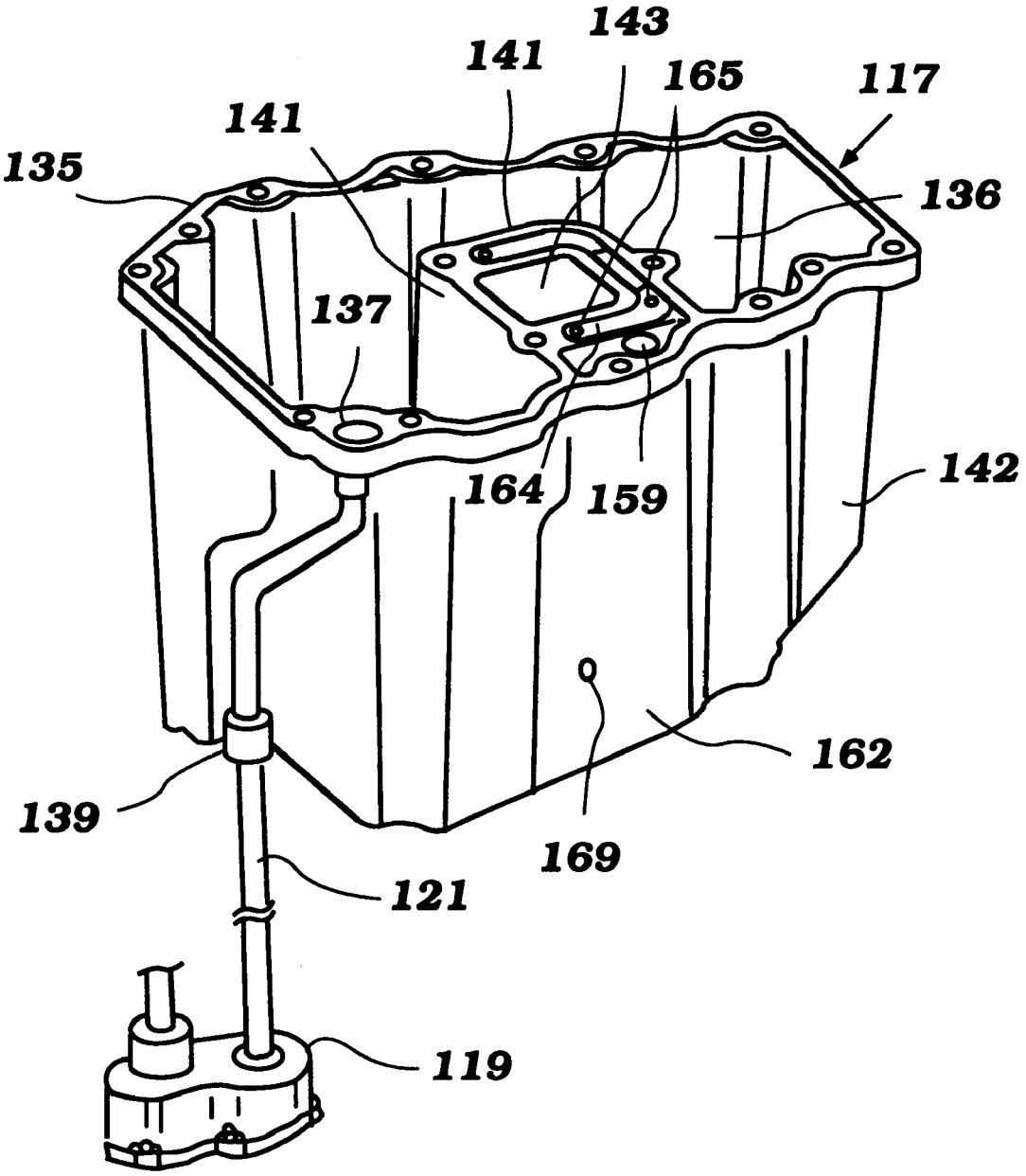
FIG. 7 is a perspective view showing the water pump and the oil pan of this embodiment.

Referring now primarily to FIGS. 5–7, it will be seen that the exhaust guide 114 is provided with a recessed cavity 132 that receives coolant from the conduit 121. This coolant is then delivered in a suitable manner to the cooling jacket of the engine 103. Returned water is delivered, at least in substantial part, to a water jacket 133 that surrounds an exhaust passage 134 in the exhaust guide 114. This water is returned to the body of water in which the watercraft 131 is operating in a manner which will be described later.

Referring first to the construction of the oil pan 117, this construction is shown perspective view in FIG. 7. The oil pan 117 has an upper peripheral flange 135 that has a number of openings so as to provide a means by which it is attached to the underside of the exhaust guide 114. As may be also seen in the Figures, the oil pan 117 is defined by upstanding outer peripheral walls that define an oil receiving chamber 136.

At one corner of the flange 135, there is provided an opening 137 to which the upper end of the conduit 121 delivers its coolant This passage 137 communicates with the exhaust guide water chamber 132 through a short passage 138. At the lower end of this outer peripheral wall, a connector 139 or hose retainer is provided that holds the intermediate end of the conduit 121 against vibration.

The oil chamber 136 is defined on its inner peripheral edge by a further upstanding wall 141 which is integrally formed with the oil pan 117 and is spaced inwardly from the outer peripheral wall 142, except for a portion, as will be noted later. This defines a generally vertically extending passage or chamber 143 through which an exhaust pipe 144 extends.

As best seen in FIG. 5, the exhaust pipe 144 is formed at its upper end with an outer peripheral flange 145 which is fixed to the exhaust guide 117 by elongated threaded fasteners 146. This configuration leaves an air gap between the outer peripheral edge of the exhaust pipe 144 and the inner surface of the wall 141 so as to provide for some heat insulation between the exhaust pipe 144 and the oil pan 117.

In addition, this space may act as an expansion chamber, in a manner which will be described, so as to provide silencing for the exhaust gases. It should be noted that the lower end of the exhaust pipe 144 in this embodiment terminates at a point which is not substantially below a lower wall 147 of the oil pan 117. As has been previously noted, more conventional structures extend the exhaust pipe much below this area and, therefore, there is a likelihood that water might be able to enter into the exhaust system. This is well above the water line WL (FIG. 4) even when the watercraft 131 is stationary in the water.

The exhaust pipe 144 terminates at its lower end within an expansion chamber 148 that is formed in the drive shaft housing 108 and thus the exhaust gases can be silenced by expansion in this expansion chamber and then discharged to the atmosphere through a suitable underwater exhaust gas discharge system, which can utilize a through the hub exhaust, of the type previously noted.

It has been noted that the lubricant is drawn from the oil pan by the oil pump 11 8. A strainer 149 depends into a lower surface of the oil pan 117 and is connected by means of a conduit 151 to a flange 152 that is mounted to the underside of the exhaust guide 114. This communicates directly with the inlet side of the oil pump 118 in any suitable manner.

It should be noted that the rearward end of the oil pan 117 extends rearwardly adjacent an upstanding integral wall 153 of the drive shaft housing 108. The lower portion of the oil pan 117 is formed with a drain nipple 154 which has an axial extent that is parallel to the axis of rotation of the drive shaft 107 and thus is vertical.

A drain plug 155 is threadingly engaged in this drain nipple 154 and is accessible through a vertically extending opening 156 formed in the rearward portion of the drive shaft housing 108 just forward and adjacent the wall 153. A combined seal and protective tube 157 is interposed between the upper end of a ledge 158 formed forwardly of the wall 153 and the lower surface 147 of the oil pan 117. This provides not only a seal but will also dampen vibrations and protect the components.

The way in which water is returned from the engine cooling jacket back to the body of water in which the water craft is operating will now be described in detail by continued reference primarily through FIGS. 5–7.

First, there is provided a main water drain passage 159 (FIGS. 6 and 7) that extends through the exhaust guide 114 and in the upper portion of the oil pan 117 which communicates with an outer peripheral volume 161 that extends between the outer peripheral wall 142 of the oil pan 117 and the inner peripheral wall of the drive shaft housing 108. This is on the outer surface of the oil pan 117 and thus provides further insulation and protection of the oil pan 117 from heat.

Also, the cooling water will flow across a portion 162 of the outer wall 142 which portion is not wetted on its internal surface by the oil in the reservoir volume 136. In other words, the oil reservoir volume 136 does not completely circle the inner wall 141 of the oil pan 117. This is the common portion with the inner wall as previously noted. Thus, the wall portion 162 is not wetted directly by the oil and this unwetted portion is in the vicinity of the water return 159.

A smaller water return path in the area of the inner wall 141 and around the periphery of the exhaust pipe 144 is provided by a weep passage 163. This passage 163 is covered on its upper portion by a shroud or seal 164 held in place by a pair of small threaded fasteners 165.

An above the water low speed idle exhaust gas discharge path will now be described also by reference to FIGS. 5–7. This is comprised of an idle exhaust gas discharge opening 116 that is formed in the upper portion of the exhaust pipe 114 adjacent the flange 145. This small opening is shielded by a baffle 167 which, in this embodiment, is affixed by welding to the outer peripheral edge of the exhaust pipe 144. The baffle 167 is interposed between the opening 161 and the weep passage 163 so as to ensure that water cannot enter the exhaust pipe in this area through the idle exhaust gas discharge 166.

Thus, when there is a high enough back pressure in the underwater exhaust gas discharge, exhaust gases may flow in the direction indicated by the arrows 168 through the exhaust pipe opening 166 and downwardly under the direction of the baffle 167 into the area 143. Thus, there is a contraction and expansion of these exhaust gases that will be provide a good silencing effect.

These exhaust gases then flow downwardly to a small opening 169 formed in the oil pan wall portion 162. Hence, this unwetted portion of the oil pan wall 162 affords an exhaust gas discharge which can be formed above the lower end of the exhaust pipe 144 and through which the exhaust gases for the above the water discharge can pass.

These exhaust gases then can flow upwardly through the cavity 161 between the drive shaft housing 108 and the outer wall 142 of the oil pan 117. Thus these gasses need not pass below the oil pan 117, as with prior art constructions. This permits the drain nipple 154 to be located as it is.

As may be seen best in FIG. 5, these exhaust gases can then flow through a restricted opening 171 formed in the upper portion of the wall 153 and defined between the shield 164 across a passage 172 that communicates with an expansion chamber 173 formed by the wall 153 of the drive shaft housing and an outer surface 174 thereof. A way in which the opening 171 may be formed will be described later by reference to FIGS. 11 and 12.

These exhaust gases can then flow through a baffle wall 175 into a further expansion chamber 176. This expansion chamber 176 communicates with and above the water idle exhaust gas discharge port 177 that is formed in the rear portion of the drive shaft housing wall 174. Thus, the idle exhaust gases have several expansions and contractions and are very effectively silenced without significant restriction. In addition, the arrangement is such that water is not likely to enter the exhaust pipe 144.

Some of the engine coolant may be discharged through a tell tale opening in the exhaust guide 114. Such an opening is identified at 178 in FIG. 5. This gives the operator a visual indication that the engine 103 is receiving coolant.

Some water may separate from the exhaust gases in the idle exhaust gas discharge. This separation occurs primarily in the expansion chamber 173 due to the expansion that takes place therein. A drain passage 179 may be formed in the lower end of the chamber 173 so as to permit this separated water to drain.

Figure 8:
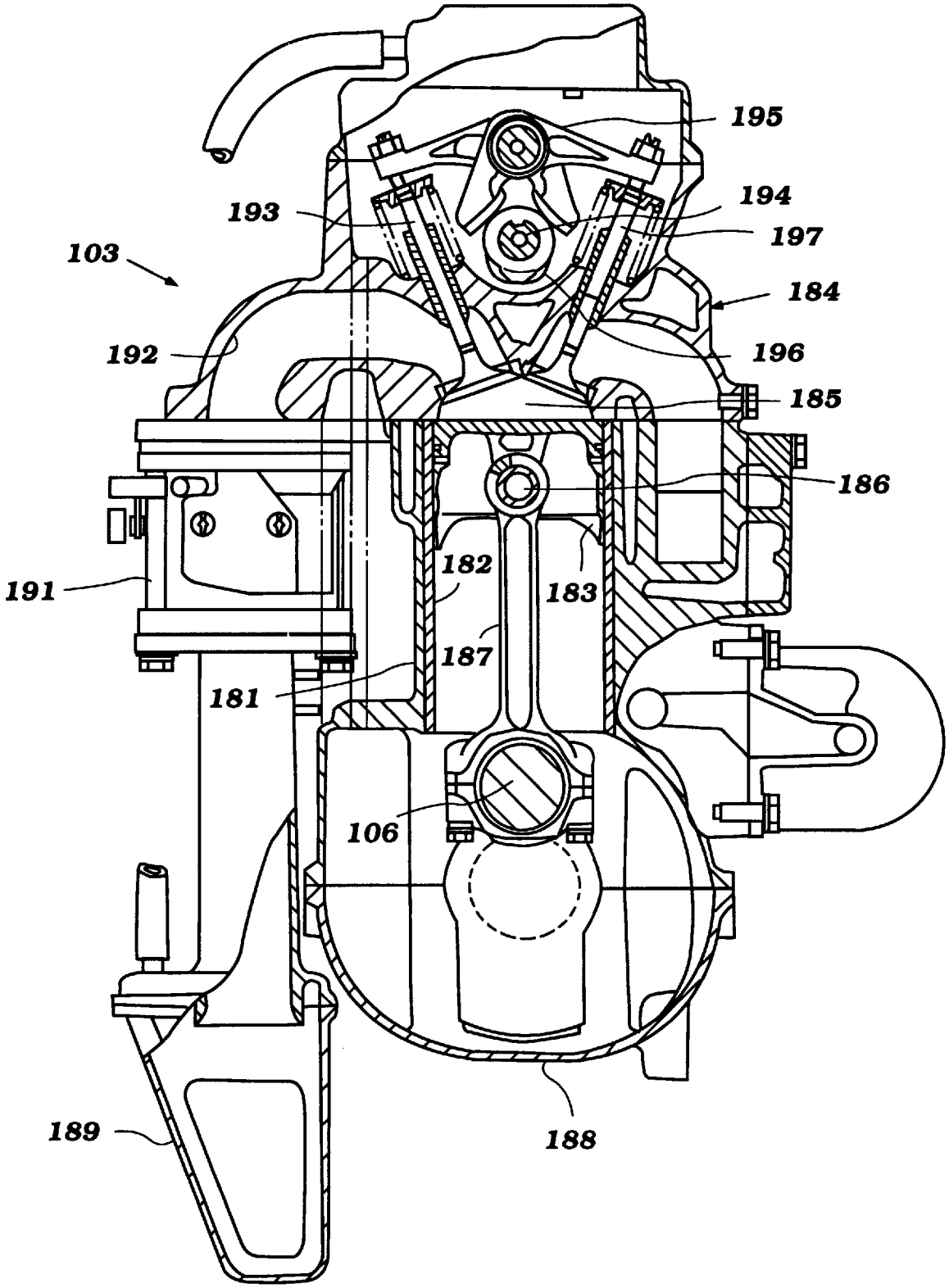
FIG. 8 is a cross-sectional view taken through one of the cylinders of the outboard motor engine of this embodiment.

It has been noted that the internal construction of the engine 103 would be described later by reference to FIG. 8. That construction will now be described by reference to that figure.

The engine 103, as has been noted in the preceding description, is in the illustrated embodiment of a two cylinder in-line type. Therefore, a cylinder block 181 is provided with a pair of vertically spaced cylinder bores 182 in which pistons 183 reciprocate. One end of these cylinder bores 182 is closed by a cylinder head assembly, indicated generally by the reference numeral 184 that is affixed to the cylinder block 181 in any suitable manner. The cylinder head assembly 184 has a recesses 185 that cooperate with the heads of the pistons 183 and the cylinder bores 182 to form the combustion chambers of the engines.

The pistons 183 are connected by means of piston pins 186 to the small ends of the connecting rods 187. The big ends of the connecting rods 187 are journaled in a known manner on the throws of the crankshaft 106.

The crankshaft 106 rotates in a crankcase chamber that is formed by the skirt of the cylinder block 181 and a crankcase member 188 that is affixed thereto.

A fuel air charge is delivered to the combustion chambers 185 by an induction system that includes an air inlet device 189 that draws atmospheric air from within the protective cowling 102. This air inlet device 189 serves a plurality of throttle bodies which may also comprise carburetors 191. These, in turn, supply their charge to intake passages 192 formed in the cylinder head assembly 184 and which terminate in valve seats that are valved by poppet type intake valves 193. The poppet type intake valves 193 are operated by means of an overhead cam shaft 194 which is driven through a suitable drive at one half crankshaft speed from the crankshaft 106. A rocker arm mechanism 195 transmits motion from the lobe 196 of the cam shaft 194 to the poppet type intake valve 193.

In a like manner, exhaust valves 197 control the flow of the exhaust products from the combustion chambers 185 to the exhaust systems which has already been described.

In order to obtain high power outputs for the engine, the timing of the opening of the intake valve 193 is such that they will open before the exhaust valve 197 complete their closure at the end of the exhaust cycle. This valve gives rise to the aforenoted potential negative pressure situations that can cause the possibility of water being drawn into the engine through the exhaust system.

In the embodiment of FIGS. 4–8, it has been noted that the exhaust pipe 144 does not extend substantially below the lower wall 147 of the oil pan 117. This, however, leaves the expansion volume 143 to serve two primary purposes. One of these is to silence the idle exhaust gas discharge. The other is to provide a cooling gap between the oil pan 117 and the exhaust pipe 114.

Figure 9:
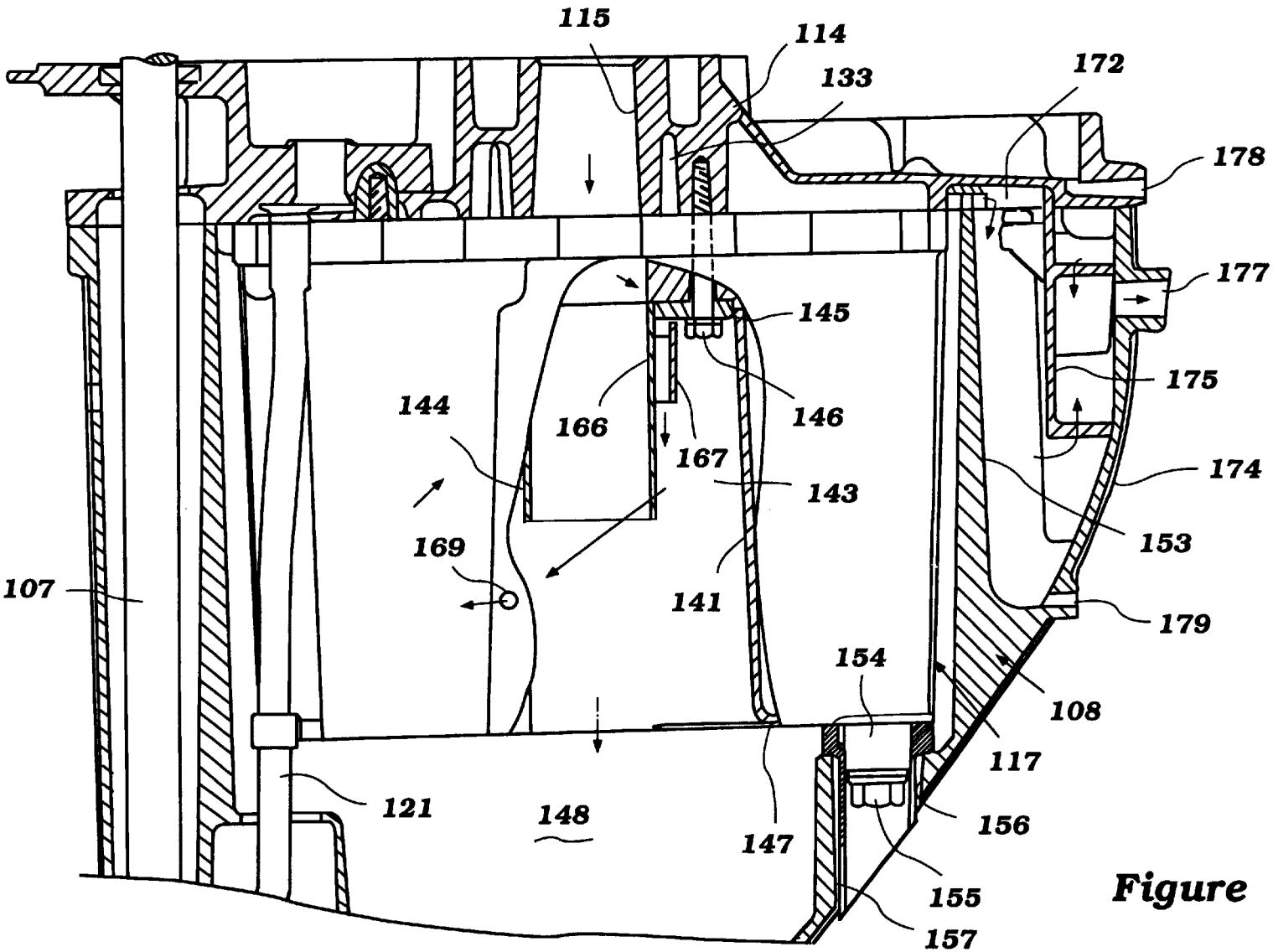
FIG. 9 is a cross-sectional view, in part similar to FIG. 5, and shows a second embodiment of the invention.

Although the volume of the expansion chamber 143 can be deemed additive to the volume of the expansion chamber 148, FIG. 9 shows another embodiment which offers further expansion chamber capabilities. This embodiment differs from the embodiment of FIGS. 4–8 only in the length of the exhaust pipe 114 and, for that reason, the components of this embodiment which are the same as those previously described have been identified by the same reference numerals. This embodiment will be described further only in so far as is necessary to understand the construction and operation of this embodiment In this embodiment, the lower end of the exhaust pipe 144 terminates substantially above the oil pan lower wall 147. In one specific example, the exhaust pipe 144 may extend for less than ½ the vertical height of the oil pan cavity 143. Thus, the volume of the cavity 143 is added to the volume 148 for the silencing effect without sacrificing the silencing provided for the idle exhaust gas discharge.

Figure 10:
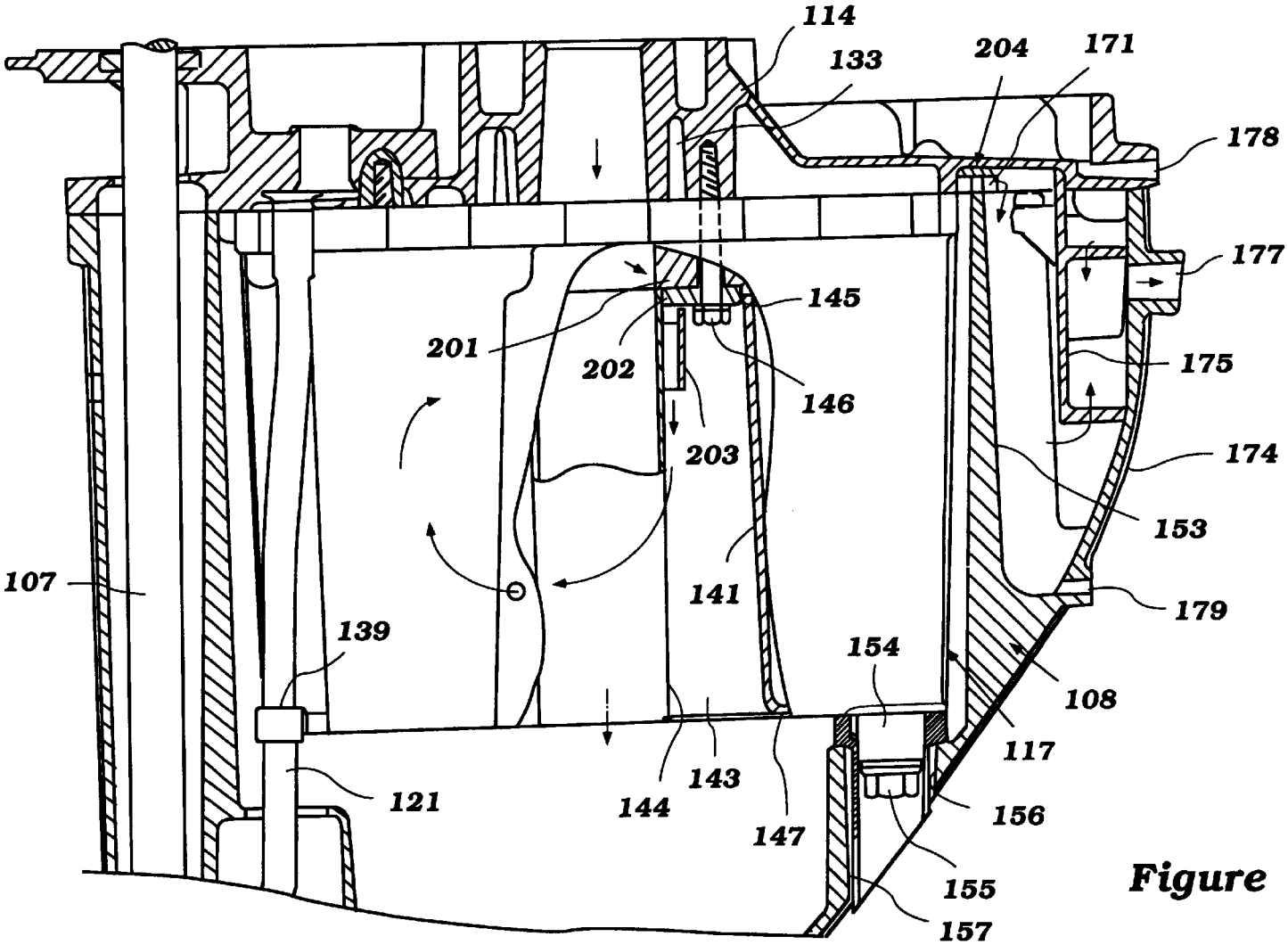
FIG. 10 is a cross-sectional view, in part similar to FIGS. 5 and 9, and shows a third embodiment of the invention.
Figure 11:
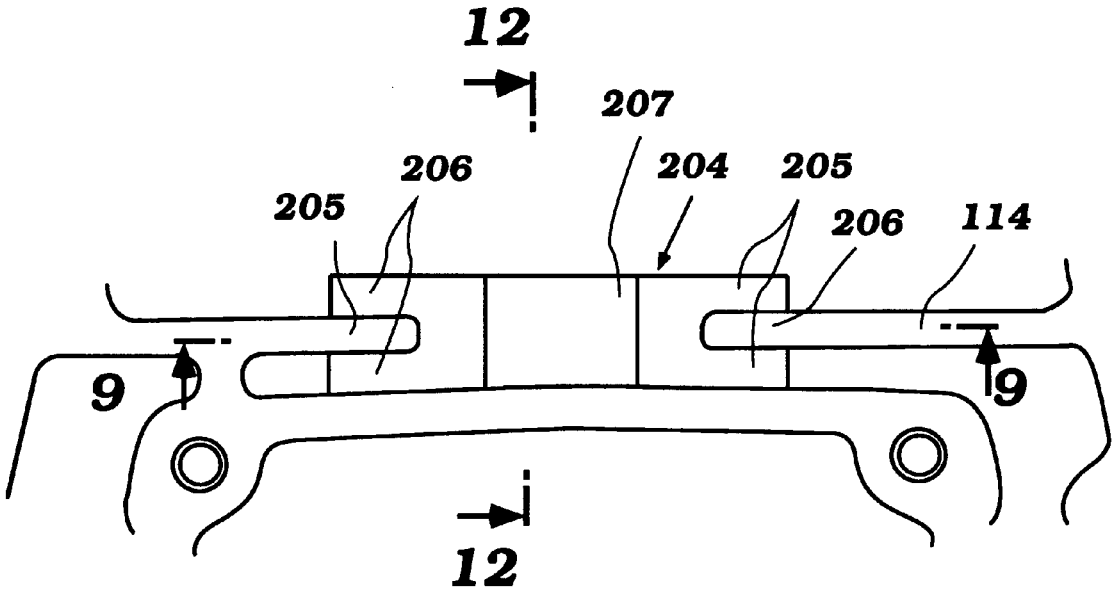
FIG. 11 is a partial view showing a portion of the idle exhaust path is formed in this embodiment.
Figure 12:
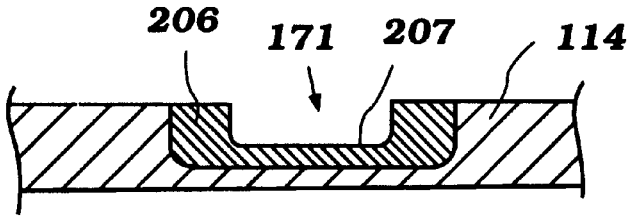
FIG. 12 is a cross-sectional view taken along the line 12—12 of FIG. 11.
Figure 13:
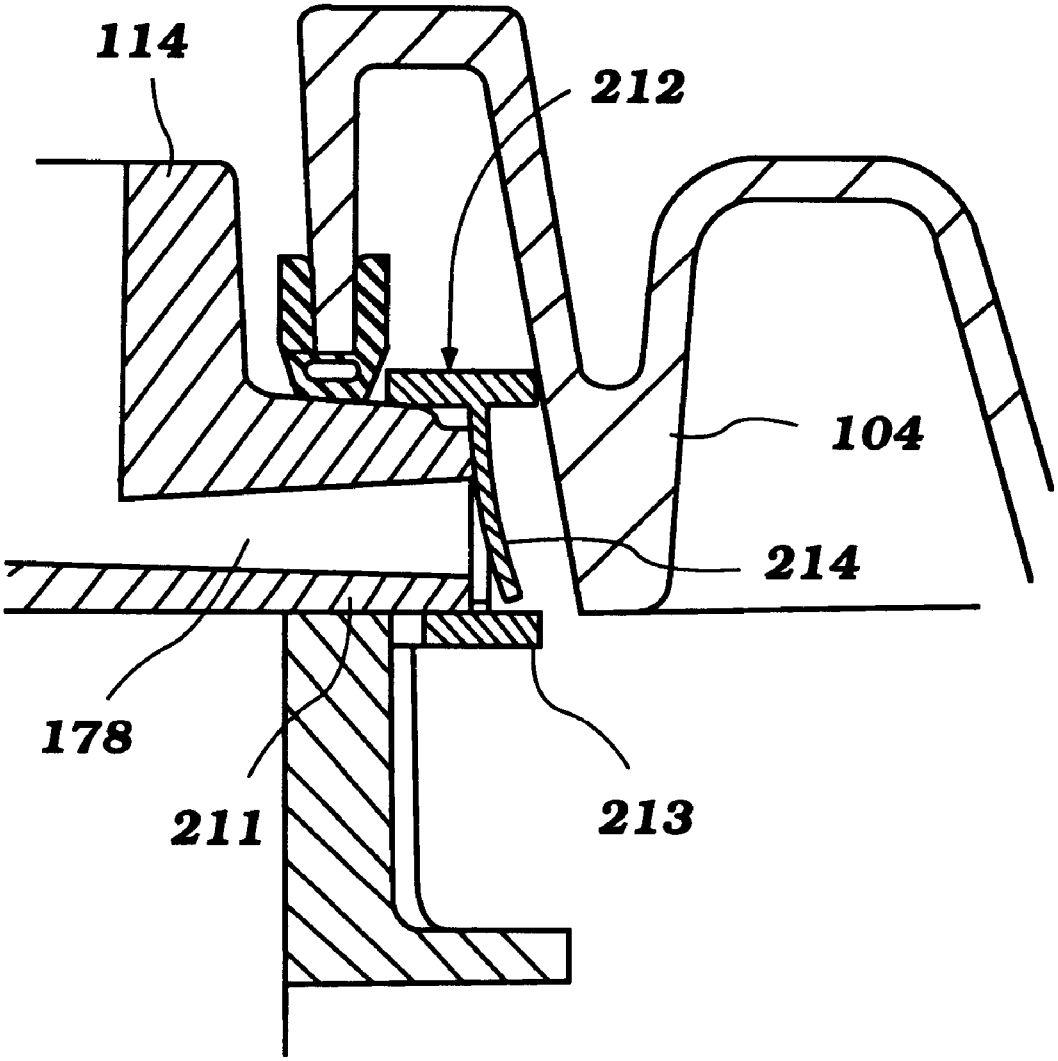
FIG. 13 is an enlarged cross-sectional view showing another possible embodiment.

FIGS. 10–12 show yet another embodiment of the invention which is basically the same as the embodiment of FIGS. 4–8. This embodiment differs from that embodiment only in the way in which the idle exhaust gas discharge is permitted to escape from the exhaust pipe 144 and the way in which it is baffled.

In this embodiment, the upper wall member of the oil pan below its flange 135 is formed with a circumferential recess 201 which extends over the flange portion 145. The flange portion 145 is then formed with a vertically extending opening 202 so that the exhaust gases may flow downwardly through the opening 202 into an area covered by a baffle 203. The baffle 203 is formed integrally with or fixed to the flange 145 and from this point forward the exhaust gas discharge path is the same as that previously described.

FIGS. 11 and 12 show the way in which the idle exhaust gases are discharged to the expansion chamber 173. Specifically a way in which the passage 171 may be formed is illustrated.

An elastic seal member, indicated generally by the reference numeral 204 is carried by the exhaust guide 114 and particularly by a pair of inwardly extending flange portions 205 thereof These are received in grooves formed by flange portions 206 of the seal number 204. A recess 207 between these flange portions 205 forms the flow opening 171.

Aside from the differences noted the remainder of this embodiment is the same as those already described. Therefore, further description of this arrangement is not believed to be necessary to permit those skilled in the art to utilize this embodiment Therefore, further description of this arrangement is not believed to be necessary to permit those skilled in the art to utilize this embodiment.

Figure 14:
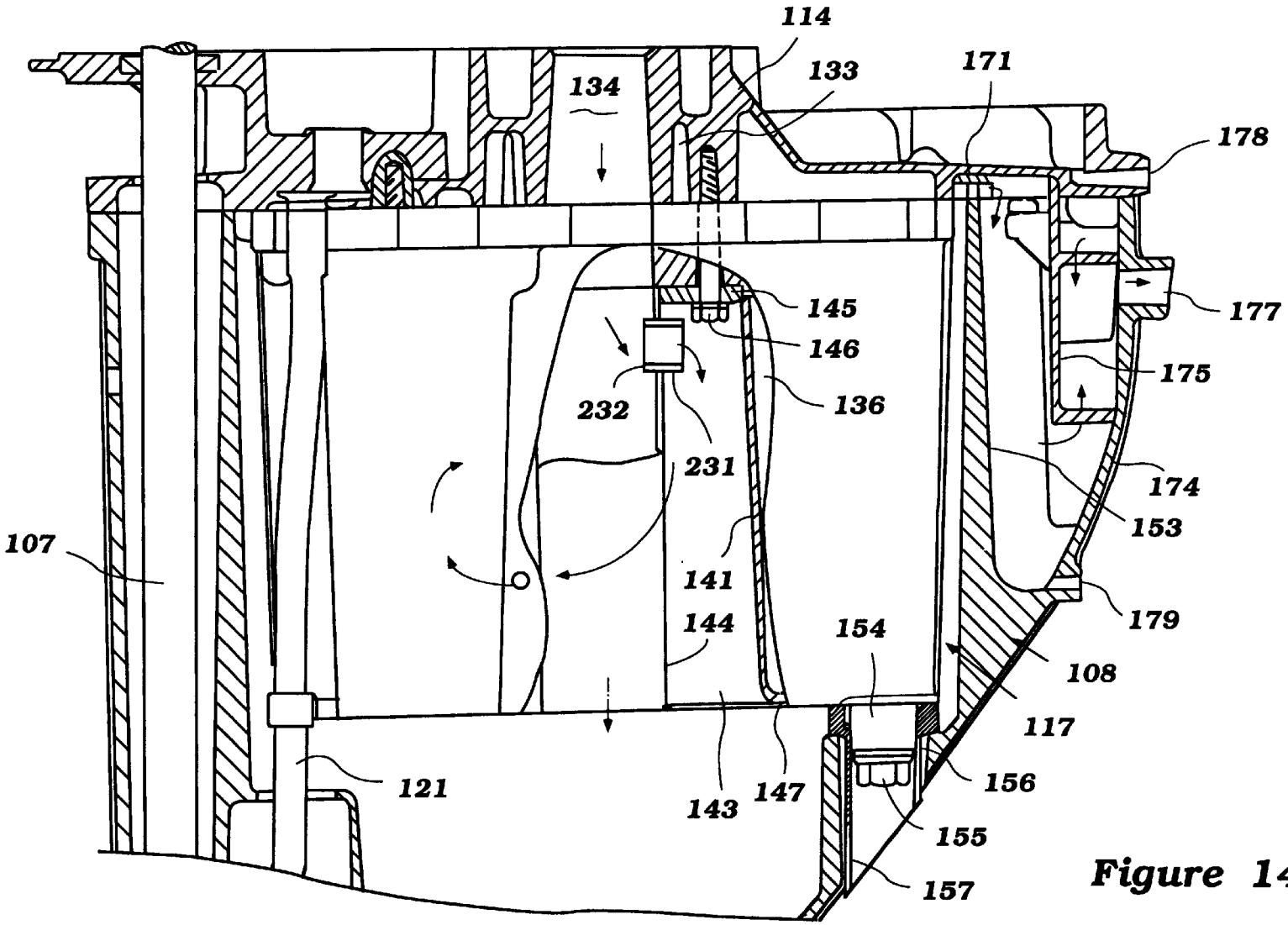
FIG. 14 is a cross-sectional view, in part similar to FIGS. 5, 9 and 10, and shows another embodiment of the invention.

It has been noted that the guide plate is formed with the tell tale opening 178. If desired it is possible to protect from water entering this opening. This may be done by forming a cylindrical projection 211 around the tell tale 178. A flapper type check valve 212 having a cylindrical portion 213 is received over the projection 211. A flap type valve element 214 cooperates with the opening 178 so as to permit the engine coolant to flow through this path, but prevents water entry through it Another embodiment of the invention is illustrated in FIG. 14 and this embodiment differs from those previously described, again primarily in the way in which the idle exhaust gases are discharged. Therefore, where components of this embodiment are the same as those previously illustrated and described, they are identified by the same reference numerals. They will be described again only insofar as is necessary to understand the construction and operation of this embodiment.

In this embodiment, the exhaust pipe 144 is formed with an opening 231 which receives an elongated tubular member 232. This tubular member 232 extends generally horizontally and has sufficient lengths so as to act itself as a shield to prevent water from flowing through it. This tubular member discharges the exhaust gases into the chamber 143 where they can flow through the remaining path described so as to be discharged to the atmosphere through the already described above the water exhaust gas discharge path.

Figure 15:
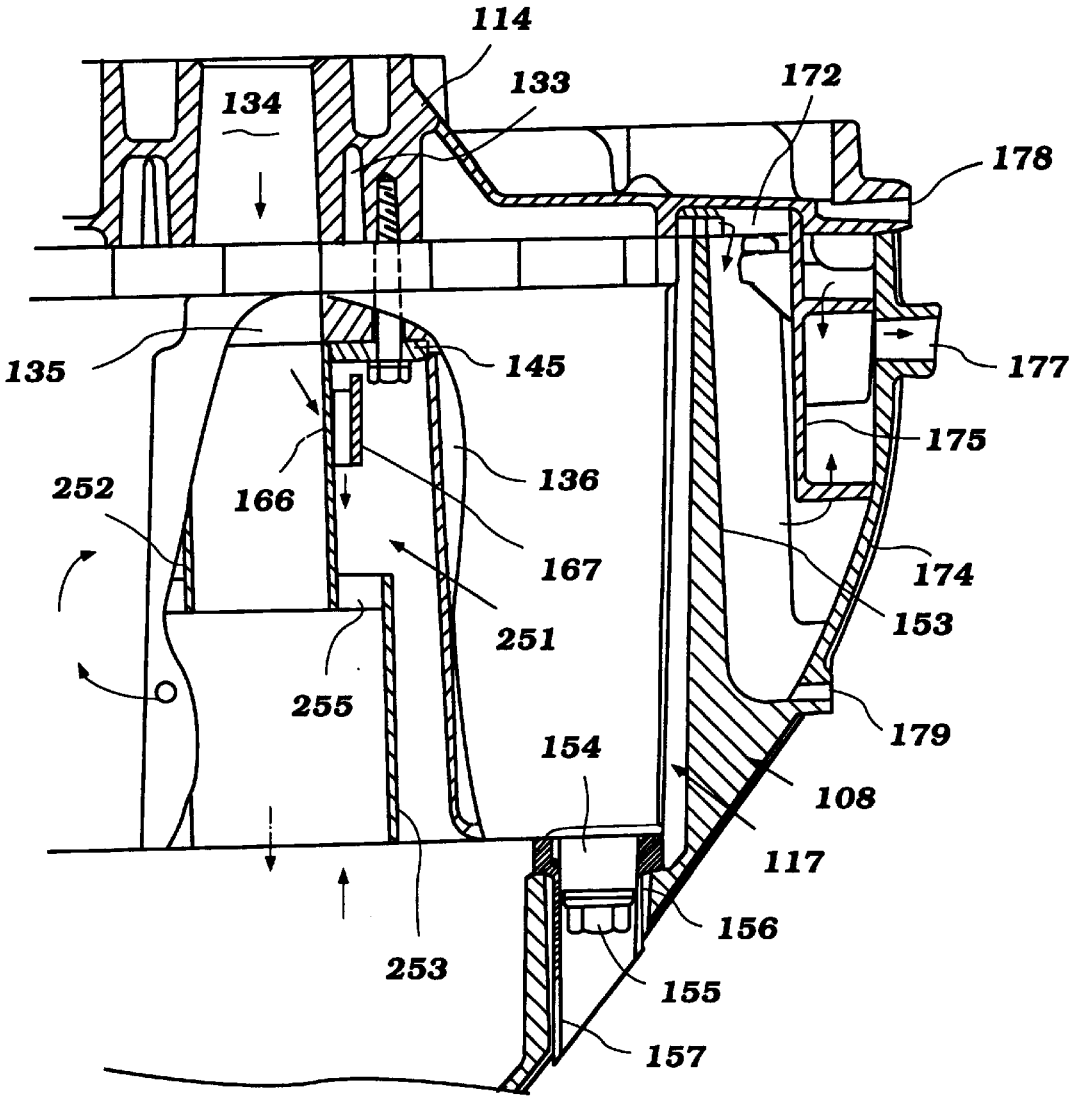
FIG. 15 is a cross-sectional view, in part similar to FIGS. 5, 9, 10 and 14 and shows yet another embodiment of the invention.
Figure 16:
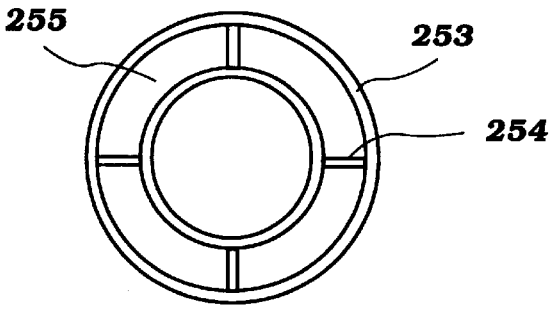
FIG. 16 is a bottom plan view of the end of the exhaust pipe in this embodiment.

FIGS. 15 and 16 show another embodiment of the invention wherein the exhaust pipe, indicated in this embodiment by the reference numeral 251, can have a greater length so as to extend to a lower level but has a construction so that its configuration will not tend to draw water back up into the engine through the main exhaust pipe 251.

To this end, the exhaust pipe 251 is formed with a first smaller diameter section 252 which depends from the flange portion 145 and which terminate approximately midway of the length of the passage 143 between the inner surface 141 of the oil pan and its outer surface. The idle discharge hole 166 as in the earlier embodiments is formed in this portion and is baffled by the baffle plate 167.

A second larger diameter pipe section 253 depends from the lower end of the pipe section 252 and is connected thereto by a plurality of circumferentially spaced ribs 254. Thus, leaves air gaps 255 between the pipe sections 252 and 253 that in effect provide a break in the suction at this point. Thus, the effective length from a water drawback standpoint is shortened but the actual length of the exhaust pipe for high speed discharges is elongated.

Figure 17:
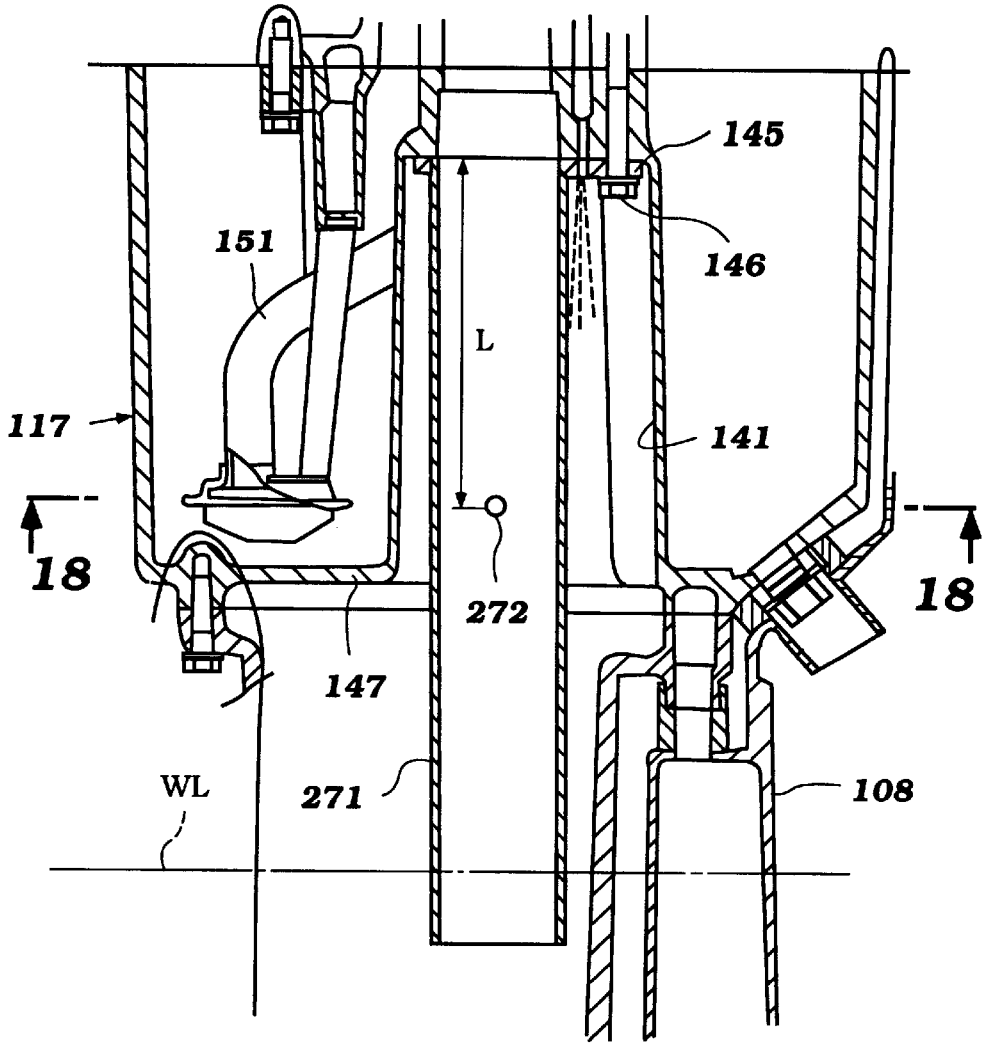
FIG. 17 is a cross-sectional view, in part similar to FIGS. 5, 9, 10, 14 and 15 and shows a still further embodiment of the invention.
Figure 18:
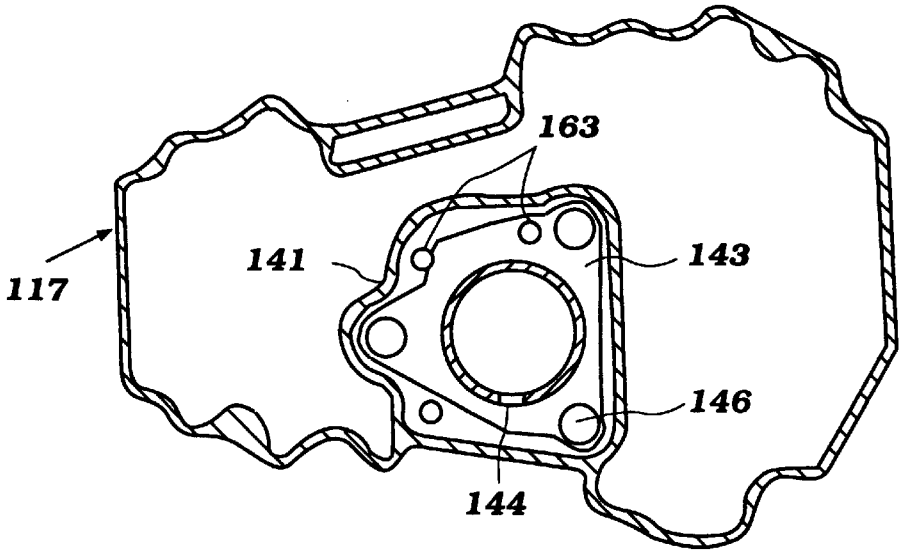
FIG. 18 is a cross sectional view, in part similar to FIG. 6, showing the oil pan configuration of this embodiment.

FIGS. 17 and 18 show another embodiment wherein the exhaust pipe, indicated in this embodiment by the reference numeral 271, has a substantially greater length than the previously described embodiment. In this embodiment, the end of the exhaust pipe 271 can be disposed below the water level WL when the watercraft is in its stationary position. However, the idle discharge hole indicated by the reference numeral 272 in this embodiment is disposed a substantial length L from the opening 134 in the guide plate 114. Thus, when operating at idle if there are negative pressures, the water will have to rise a substantial height before it can reach even this point and thus, it is unlikely that there will be water intrusion.

Figure 19:
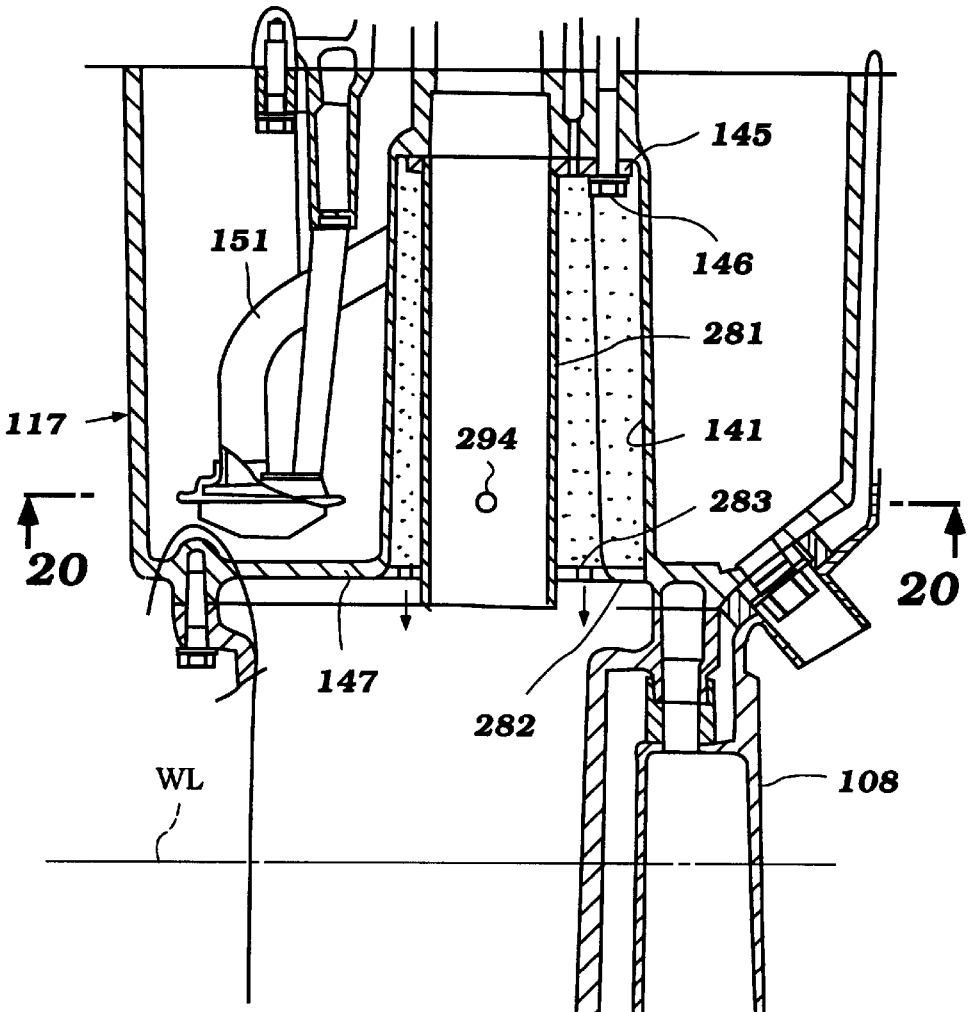
FIG. 19 is a cross-sectional view, in part similar to FIGS. 5, 9, 10, 14, 15, and 17 and shows the final illustrated embodiment of this invention.
Figure 20:
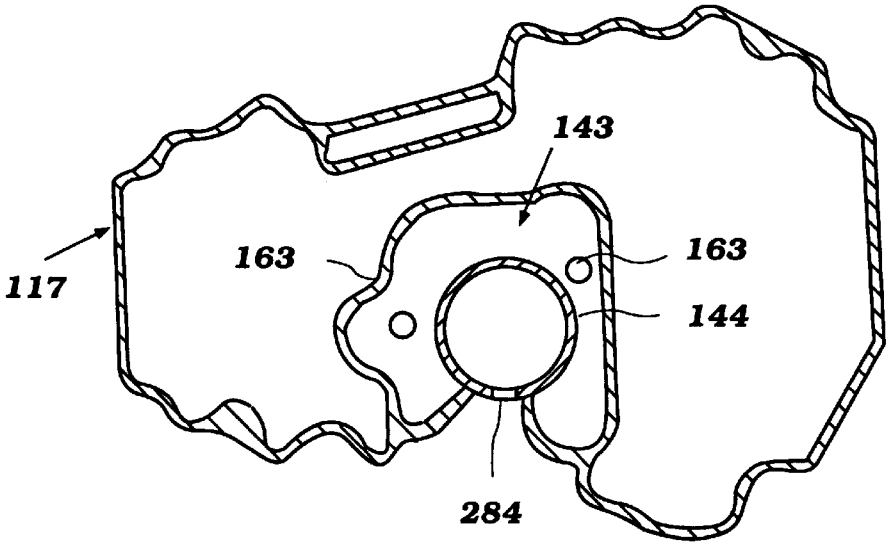
FIG. 20 is a cross-sectional view, in part similar to is a FIGS. 6 and 18 and shows the oil pan configuration of this embodiment.

FIGS. 19 and 20 show a final embodiment which employs a water jacket that extends around a substantial portion of the circumference of the exhaust pipe, indicated by the reference numeral 281 in this embodiment. A lower wall member 282 extends between the inner periphery of the oil reservoir 117 and the outer surface of this exhaust pipe. Small drain openings 283 are formed in this plate so that water can drain out of this area. An idle discharge hole 284 is formed, however, in a section of the exhaust pipe 281 which is not waterjacketed as best seen in FIG. 10. As a result, water is totally removed from the area around the idle discharge opening 284 and will not be drawn back into the engine through the exhaust system even under idle operation.

Thus, from the foregoing description it should be readily apparent that the described embodiments of the invention provide a very effective and efficient exhaust gas system for an outboard motor that cooperates with the oil pan so as to permit good silencing and to ensure against water entry into the engine through the exhaust system. Also the oil pan is protected from the idle exhaust gasses to avoid corrosion. Of course, the foregoing description is that of preferred embodiments of the invention and various changes and modifications may be made without departing from the spirit and scope of the invention, as defined by the appended claims.

We claim:

1. A four cycle outboard motor comprised of a power head, an exhaust guide supporting at least in part a four cycle internal combustion engine in said power head, said exhaust guide being supported at the upper end of a drive shaft housing and lower unit that depend from said power head, a drive shaft driven by said engine and journaled within said drive shaft housing and lower unit for driving a propulsion unit therein for propelling an associated watercraft through a body of water, an oil pan is supported at least in part on the underside of said exhaust guide within the drive shaft housing and lower unit for containing lubricant for said engine, said oil pan defining an internal cavity passing vertically therethrough, and an exhaust pipe depending from said exhaust guide and extending through said oil pan internal cavity for receiving exhaust gases from said engine and for delivering them to said drive shaft housing and lower unit, said exhaust pipe having an upper portion communicating with said exhaust guide for receiving exhaust gasses passing therethrough and having a first diameter and an extension portion depending from the lower end of said upper portion, an air gap formed between said upper portion and said larger diameter extension portion to provide a suction break, said exhaust pipe terminating at a point that is no lower than substantially the lower surface of the oil pan.

2. A four cycle outboard motor as set forth in claim 1, wherein the termination of the exhaust pipe is substantially vertically aligned with the lower surface of the oil pan.

3. A four cycle outboard motor as set forth in claim 1, wherein the termination of the exhaust pipe upper portion is at a point substantially above the lower surface of the oil pan.

4. A four cycle outboard motor as set forth in claim 3, wherein the termination of the exhaust pipe upper portion is at a point no greater than one-half of the height of the internal cavity.

5. A four cycle outboard motor as set forth in claim 1, wherein there is an air space provided between the external surface of the exhaust pipe and wall of the oil pan that defines the internal cavity.

6. A four cycle outboard motor as set forth in claim 5, further including means for providing a restricted flow path of idle exhaust gases from the engine to the space between the outer surface of the exhaust pipe and the internal cavity for discharge to the atmosphere through and above the water idle exhaust gas discharge path.

7. A four cycle outboard motor as set forth in claim 6, wherein the restricted path is formed by an opening in the exhaust pipe.

8. A four cycle outboard motor as set forth in claim 8, wherein a portion of one of the walls of the oil pan that defines the internal cavity is exposed to the interior of the drive shaft housing on its other side and is not wetted by the lubricant in said oil pan, said unwetted wall portion having an opening for receiving the idle exhaust gases and discharging them to the atmosphere through an opening in the upper portion of said outboard motor and which is disposed above the water level at all times during watercraft operation.

9. A four cycle outboard motor as set forth in claim 7, wherein the opening in the exhaust pipe is formed in the exhaust pipe upper portion contiguous to an upper end thereof.

10. A four cycle outboard motor as set forth in claim 6, wherein the engine is water-cooled and wherein at least at portion of the water that passes through the engine for its cooling is delivered to the space between the outer surface of the exhaust pipe and the internal cavity of the oil pan.

11. A four cycle outboard motor as set forth in claim 10, further including means for shielding the path of idle exhaust gas discharge from the engine into the space between the exhaust pipe and the internal cavity of the oil pan from the cooling water that is introduced into said space.

12. A four cycle outboard motor as set forth in claim 11, wherein the restricted path is formed by an opening in the exhaust pipe.

13. A four cycle outboard motor as set forth in claim 12, wherein the means for precluding water for shielding the coolant from the idle exhaust gases comprises a baffle placed over the exhaust pipe opening.

14. A four cycle outboard motor comprised of a power head, an exhaust guide supporting at least in part a four cycle internal combustion engine in said power head, said exhaust guide being supported at the upper end of a drive shaft housing and lower unit that depend from said power head, a drive shaft driven by said engine and journaled within said drive shaft housing and lower unit for driving a propulsion unit therein for propelling an associated watercraft through a body of water, an oil pan is supported at least in part on the underside of said exhaust guide within the drive shaft housing and lower unit for containing lubricant for said engine, said oil pan defining an internal cavity passing vertically therethrough, and an exhaust pipe depending from said exhaust guide and extending through said oil pan internal cavity for receiving exhaust gases from said engine and for delivering them to said drive shaft housing and lower unit, said exhaust pipe terminating at a point that is no lower than substantially the lower surface of said oil pan, and a wall closing the area between the lower end of said exhaust pipe and said internal cavity of said oil pan to form a water chamber around said exhaust pipe.

15. A four cycle outboard motor as set forth in claim 14, wherein the wall is formed with a drain opening through which the water from the water chamber may drain.

* * * * *

UNITED STATES PATENT AND TRADEMARK OFFICE

CERTIFICATE OF CORRECTION

PATENT NO. : 6,027,385
DATED : February 22, 2000
INVENTOR(S) : Katayama et al.

It is certified that error appears in the above-identified patent and that said Letters Patent is hereby corrected as shown below:

Column 13,
Line 53, "set forth in claim 8," should be -- set forth in claim 7, --

Signed and Sealed this

Sixteenth Day of September, 2003

JAMES E. ROGAN
*Director of the United States Patent and Trademark Office*